United States Patent [19]

Hunt

[11] 4,209,122

[45] Jun. 24, 1980

[54] MANUFACTURE OF HIGH PERFORMANCE ALLOY IN ELONGATED FORM

[75] Inventor: James G. Hunt, Terrace Park, Ohio

[73] Assignee: Polymet Corporation, Cincinnati, Ohio

[21] Appl. No.: 970,658

[22] Filed: Dec. 18, 1978

[51] Int. Cl.[2] ..... B23P 17/00

[52] U.S. Cl. ..... 228/173 E; 29/419 R; 29/423

[58] Field of Search ..... 29/419 R, 423, 424, 29/527.5, 527.7; 228/173 E

[56] References Cited

U.S. PATENT DOCUMENTS

| | | | |
|---|---|---|---|
| 2,050,298 | 8/1936 | Everett | 29/419 R |
| 3,394,213 | 7/1968 | Roberts et al. | 29/423 |

*Primary Examiner*—Lowell A. Larson
*Attorney, Agent, or Firm*—Edmund S. Lee, III

[57] ABSTRACT

A method of manufacturing wire is described. "High performance" alloy rods in an "as cast" condition are incorporated into a filled billet which is extruded within defined extrusion parameters to obtain a simultaneous reduction in the diameters of the cast rods. After separation from the filled billet, the extruded "high performance" rods, now in wire form, are particularly suitable for manual welding applications of hard facing deposits. The separated "high performance" alloy wires are joined by butt welding to form a wire of indeterminable length which is accurately sized by successive drawing and annealing steps, making it suitable for use with an automatic welding machine to weld hard facing deposits. An optional second extrusion step is also described.

6 Claims, 8 Drawing Figures

FIG 4
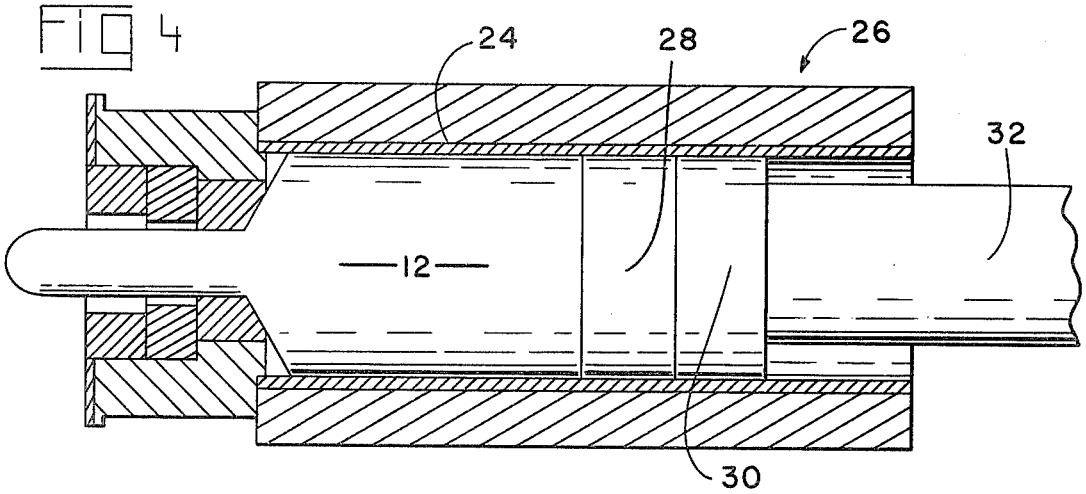
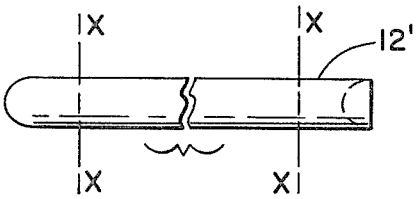
FIG 5
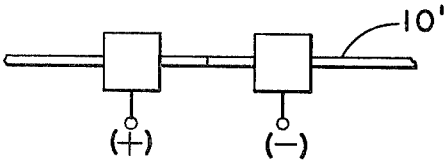
FIG 6
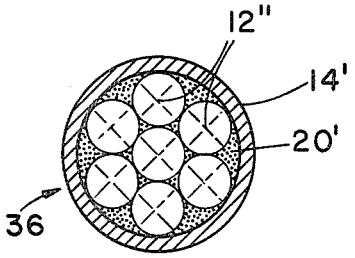
FIG 7
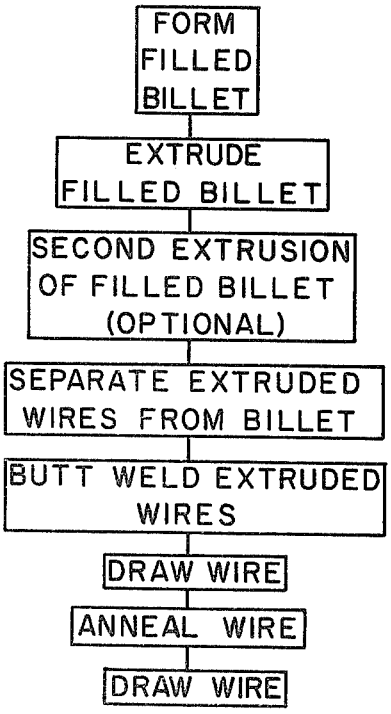
FIG 8

MANUFACTURE OF HIGH PERFORMANCE ALLOY IN ELONGATED FORM

The present invention relates to improvements in the manufacture of "high performance" alloys of extended length and relatively small cross section and more particularly to the manufacture of such alloys in wire form.

While not necessarily so limited, the present invention is motiviated by the long existing need of hard facing fabricators for certain "high performance" alloys in wire form capable of being deposited by gas tungsten arc or atomic-hydrogen arc welding.

Hard facing is a well known technique whereby selected portions of an article are surfaced with a material which has specialized characteristics not found in the base material, which, generally speaking, will be a less expensive material than the hard facing. Typically, hard facing is provided to increase the wear life of such items as shears, dies, valves and pulverizing hammers. Such items have surfaces or edges which are subject to extreme abrasion and/or elevated temperatures in their working enviroments. By hard facing these edges and surfaces wear life can be increased as much as fifty times and more.

Prior to my invention, it has been recognized that certain "high performance" alloys, as will be later defined in greater detail, have superior characteristics as hard facing materials, particularly in providing wear and abrasion resistance at elevated temperatures. Hitherto the use of such alloys in hard facing applications has been limited because of their unavailability or limited availability in wire form.

For applications of the type herein contemplated, the hard facing material must necessarily be applied by fusion with the base material, or substrate, of the article to which it is applied. Several welding processes are generally suitable for effecting such fusion. However, the gas tungsten arc or atomic-hydrogen arc method is preferred in many applications for reasons recognized by those skilled in the art.

A requisite of these arc methods of deposition is that the hard facing material be in the form of an elongated rod of relatively small cross section for manual welding and, for automatic welding, the hard facing material should be in the form of wire, preferably wound on a spool for high production capability.

Briefly, the small diameter of the hard facing wire is required in order that the material may be accurately deposited on the workpiece both to minimize the amount used as well as to reduce the amount necessary to be removed in the final finishing operations. A further consideration is that the small diameter wire, as well as the arc processes themselves minimize heat imput to the base structure avoiding or minimizing such problems as dilution of the hard facing material with the substrate and heat distortion or of thermal shock to the article.

With these considerations in mind it becomes apparent that hard facing wire must be of a uniform diameter and free of defects, such as voids, in order to obtain a uniform, accurately controlled deposit. Where automatic welding is employed, the tolerance of the hard facing wire diameter becomes even more critical in order for it to be accepted by the feeding mechanism of the automatic machines which are used for such purposes.

To a limited extent "high performance" alloys have been provided in wire form through powder metal technology. Powder metal technology is not only inherently expensive, but, at least for now, it is employed to fabricate wire from but a relatively few of the "high performance" alloys. A further significant limitation is that "high performance" alloys formed by powder metal technology contain entrained gasses and other impurities which "spark", or sputter during welding thereby fouling the electrodes of the welding machine. All of this causes production losses due to down time required for cleaning the electrodes and scrapped production.

The desirability of such "high performance" alloys as hard facing materials is further evidenced by attempts to obtain the necessary small diameter, or wire form, by grinding cast rods. This becomes an even more expensive procedure. That is, such alloys "as cast" are so brittle that grinding is difficult, particularly at small diameters, say under 0.075 inch. Additionally, casting flaws such as "hot tears" and "center-line-shrink" make it difficult to obtain wires of any substantial length.

At the present time "high performance" alloys, as a class are, by and large, applied only by processes utilizing powder, such as spray welding and plasma arc welding. The former process is limited as to the thickness of hard facing that may be applied while the latter process is unduly expensive for many applications. In any event, the gas tungsten arc and atomic-hydrogen arc methods offer a great potential for hard facing "high performance" alloys which has been severely limited by the unavailability of these alloys in suitable wire form.

Accordingly, a primary object of the present invention is to expand the availability of "high performance" alloys in wire form suitable for hard facing applications.

Another object of the present invention is to provide "high performance" alloys in lengths and relatively small diameters meeting the requirements for their application as a hard surfacing by gas tungsten arc and atomic-hydrogen arc welding.

A further object of the invention is to provide "high performance" alloys in wire form having an accurately controlled diameter suitable for use in automatic welding machines employed in applying hard facing deposits.

A further object of the invention is to provide such "high performance" alloy wire which is essentially free of entrained gasses and other impurities which would foul the electrodes of a welding machine.

Yet a further and broader object of the invention is to economically provide "high performance" alloys in elongated form with a high length to diameter ratio.

These ends are broadly attained by first positioning a plurality of cast "high performance" alloy rods in a hollow cylinder, or can. The rods may be in an "as cast" condition and have a diameter between approximately one eighth and one half inch.

The rods are disposed in parallel relationship to each other and to the axis of the can. One end of the can is closed by a cap and the interior of the can is filled with filler material compacted to a relative density of at least 0.33. The other end of the can is closed off by a cap to complete a filled billet which is then preheated to a temperature approximating the forging temperature of the "high performance" alloy for a period of time sufficient for all portions of the filled billet to come up to that temperature.

The preheated billet is then extruded in an extrusion press to simultaneously reduce the diameters of the cast rods. The extrusion pressure is between 30 and 120 tons/inch$^2$ with an extrusion rate between 50 and 250 inches per minute and an area reduction between 3 and 45 times.

After air cooling, the extruded "high performance" alloy rods may be removed. At this point the extruded rods, now in wire form, will be suitable for many uses, including manual welding of hard facing deposits.

In order to obtain a wire of indeterminant length, the ends of the extruded billet are cropped off before the extruded rods, or wires are removed. After removal the lengths of extruded rod are joined, end-to-end, to form a wire of desired length. This wire is then drawn to further reduce its diameter and accurately size it to a desired dimension. A plurality of drawing steps may be employed, between which it is preferable to anneal the wire by heating it to a temperature of about 2000° to 2200° F. in a non-oxidizing atmosphere and then rapidly cooling it to room temperature.

Optionally, after the filled billet is extruded, a second extrusion step can be employed to further reduce the diameter of the cast rods. Preferably the first billet may be cropped at its ends and then cut into segments. These segments are then incorporated in a second filled billet which is extruded in essentially the same fashion as the first billet. Thereafter, the extruded lengths of "high performance" alloy wire are removed and may be joined by butt welding and drawn to obtain an accurately sized diameter.

The above and other objects and features of the invention will be apparent from the following description of a preferred mode of practicing the invention wherein reference is made to the accompanying drawings and specific examples are given, with the novelty thereof pointed out in the appended claims.

In the drawings:

FIG. 4 is a simplified longitudinal section of an extrusion press employed in the present invention;

FIG. 5 is an elevation of an extruded filled billet;

FIG. 6 is a diagrammatic illustration of a joining step employed in the present invention;

FIG. 7 is a cross section of a billet employed in an optional, second extrusion step; and FIG. 8 is a block diagram illustration of the method steps employed in the practice of the present invention.

Figure 1:
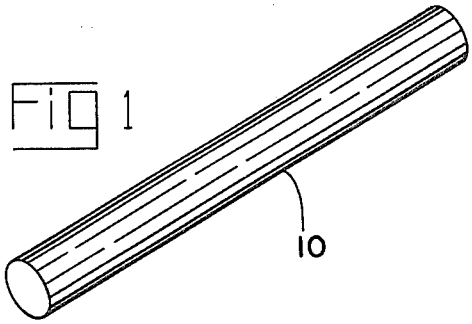
FIG. 1 is a perspective view of a cast "high performance" alloy rod employed in the practice of the present invention.

Before describing, in detail, the method of practicing the present inention, the term "high performance" alloy will be more fully defined. Actually, this term is imprecise as are many similar terms, such as "super alloy:, used in the metallurgical field. Basically though, "high performance" alloys include those alloys which comprise a moderate percentage of carbides and/or borides in addition to other constituents which provide a high degree of hardness and/or abrasion resistance and, usually, the further capability of maintaining these properties at elevated temperatures. Such alloys are also characterized by being essentially unworkable at ordinary room temperatures because of their brittleness in addition to their hardness and abrasion resistance properties. Difficulties in the workability of such "high performance" alloys may also be attributed to the faults found in their castings, such as "hot tears" and "center-line shrink" mentioned above.

Metallurgically, and in a narrower sense, "high performance" alloys are characterized by a plurality of constituent of which nickel, chromium, or cabalt or a combination of these elements generally constitute the major portion of the alloy. More particularly such alloys are characterized by a hardening mechanism which gives them the desirable properties of abrasion resistance and hardness, and the ability to maintain such properties at elevated temperatures. Such hardening mechanisms likewise cause the "high performance" alloys to be brittle and essentially unworkable at ordinary room temperatures. Typically, the hardening mechanisms are provided by intermetallic compounds in various complex phase relationships. Transitional metallic carbides and borides are representative of the hardening mechanisms employed. Additionally such alloys will include one or more elements from the group consisting of tungsten, molybdenum, manganese, silicon, iron and vanadium. Alloys of such composition and characteristics, and their equivalents are broadly included within the term "high performance" alloys as employed herein.

In a more specific sense, the term "high performance" alloy is limited to nickel and cobalt based alloys of such moderate carbon content with or without boron, which are exemplified by the alloy compositions set forth in Groups 4A, 4B and 4C of Table 2, Metals Handbook, Volume 6, Eighth Edition, (1971), American Society for Metals, Metals Park, Ohio 44073, at page 155. These alloys are specifically identified as being particularly suited for use in hard facing.

The following table lists commercially available compositions of the above identified hard facing alloys:

| NOMINAL CHEMICAL COMPOSITION (Weight per cent) | | | | | | | | | | | |
|---|---|---|---|---|---|---|---|---|---|---|---|
| Cr | Ni | Co | C | B | Fe | Si | W | Mo | Mn | V | NAME |
| 30.0 | | Bal. | 2.5 | | | | 12.0 | | | | Stellite 1* |
| 28.0 | | " | 1.1 | | | | 4.0 | | | | Stellite 6* |
| 29.0 | | " | 1.3 | | | | 8.0 | | | | Stellite 12* |
| 27.0 | 2.8 | " | .25 | | | | | 5.0 | | | Stellite 21* |
| 8.2 | # | " | .08 | | # | 2.6 | | 27.5 | 1.0 | | Tribaloy 400** |
| 17.0 | # | " | .08 | | # | 3.3 | | 27.5 | 1.0 | | Tribaloy 800** |
| 27.0 | 5.0 | " | .85 | .05 | .5 | 1.0 | 19.0 | | .01 | 1.1 | PWA 694* |
| 15.0 | Bal. | | .40 | 3.5 | 4.0 | 4.0 | | | | | Stellite 40* |

-continued

| NOMINAL CHEMICAL COMPOSITION (Weight per cent) | | | | | | | | | | | |
|---|---|---|---|---|---|---|---|---|---|---|---|
| Cr | Ni | Co | C | B | Fe | Si | W | Mo | Mn | V | NAME |
| 12.0 | Bal. | | .35 | 2.5 | 3.0 | 3.5 | | | | | Stellite 41* |

#Combined Nickel and Iron Total 3.0
*Stellite Division of Cabot Corp. Kokomo, Indiana
**Arcos Corp. Philadelphia, Pennsylvania From the foregoing it will be apparent to those skilled in the art that the term "high performance" alloys defines a class of materials which is further characterized as being, economically incapable of being converted directly from a cast form to a wire form, particularly a wire form which would be suitable for hard facing deposition, as above discussed.

Figure 2:
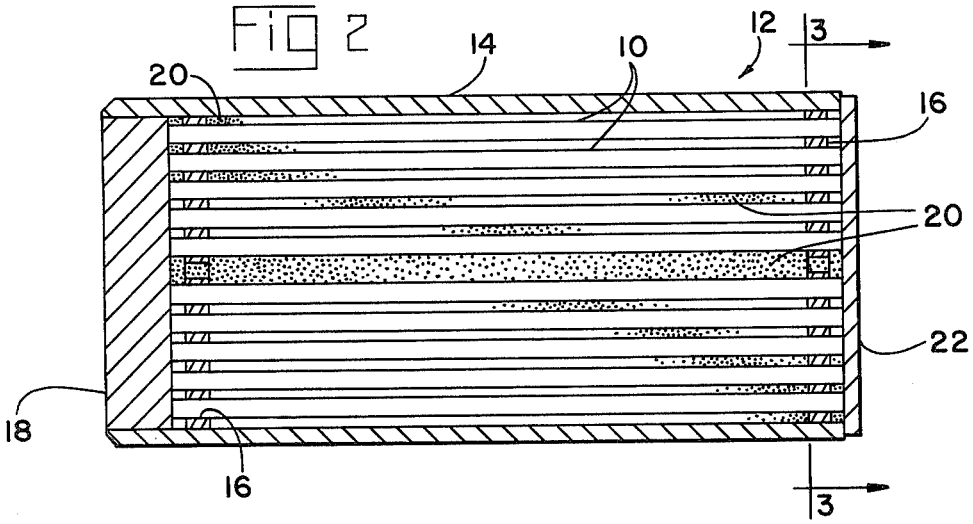
FIG. 2 is a longitudinal section of a filled billet in which a plurality of cast "high performance" alloy rods are positioned.
Figure 3:
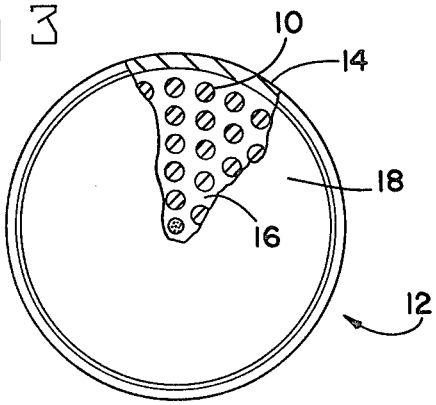
FIG. 3 is a section taken partially on line 3—3 in FIG. 2.

With these factors in mind, reference is made to FIG. 1 in the drawings which depicts a cast "high performance" alloy rod 10. FIGS. 2 and 3 then illustrate a plurality of the rods 10 incorporated into a composite, filled billet 12.

Such filled billets, in general terms, are well known to those skilled in the are and are adapted to be extruded to effect a simultaneous reduction in the cross sectional area of a plurality of articles.

Briefly, the composite billet 12 is formed by positioning a plurality of the rods 10 within a hollow cylinder, or can, 14. Opposite end portions of the rods 10 are recieved by holes in fixtures 16 to maintain them in spaced parallel relation to each other and to the axis of the can 14. A cap 18 may be attached to what will become the front end of the can 14 and then filler material 20 introduced to completely fill the spaces between the several rods 10 and between the rods 10 and the interior surface of the can 14. The opposite or rear end of the can 14 may then be closed off by a relatively thin cap 22.

This filled billet may then be extruded to simulataneously reduce the diameters of the several rods 10 employing presently available extrusion equipment.

From what has been described to this point, it will be apparent that filled billet extrusion is a well known metal working process. However, prior work and teachings in this art suggest that "high performance" alloy castings cannot be successfully processed by filled billet extrusion. Among the problems indicated by such prior teachings are excessive surface striations, segregation of the alloy's complex carbides and aggravation of casting flaws such as "hot tears". Such problems, singly or in combination would cause "high performance" alloy extrusions to be unacceptable for purposes of hard facing as herein contemplated.

Nonetheless, it has been discovered that, by employing the parameters now to be described, cast "high performance" alloy rods can be converted directly to wire form by the filled billet extrusion process and then converted to coilable wire of indeterminable length.

For such purposes the cast rods 10 need not be "worked", but may be incorporated into the filled billet 12 in their "as cast" condition. The diameter of the cast rods 10 is selected between about one-eighth of an inch and one-half of an inch. The rods may be founded by such known processes as sand casting, investment casting and the more recently developed process of aspiration casting.

The filler material 20 is a particulate or powdered material which is agitated or otherwise settled when introduced into the can 14 so that it has a relative density of at least 0.33 and preferably at least 0.45. Further the filler material is characterized, when compacted, by an extrusion constant which, optimally approximates that of the rods 10 and in any event is no more than 40% greater or less than the extrusion constant of the rods 10, and preferably is within 25% of that of the rods 10.

Extrusion constants are readily determined by the known relationship of $k=P/\ln R$, wherein k is the extrusion constant expressed in tons/inch$^2$; P is the extrusion pressure expressed in tons/inch$^2$; and R is the natural logarithm of the reduction ratio, i.e., the ratio of the cross sectional area before extrusion to the cross sectional area after extrusion. It will also be noted that extrusion constants generally tend to decease with increasing temperatures and the filler material 20 should be selected with this factor in mind.

The filler material 20, as is the case in most filled billet extrusions, should also be essentially chemically inert with respect to the alloy of the rods 10 so that there will be a minimal effect on its composition. Likewise, the filler material should be readily subject to selective attack by acid or otherwise separable from the rods to permit separation of the extruded rods therefrom.

Particulate metals having a maximum dimension in the order of 0.005 inch are particularly adaptable as filler materials to obtain the desired minimum relative densities. Monel (70%Ni-30%Cu) in powdered form is a satisfactory filler material meeting the desired characteristics set forth above. Iron or low carbon steel powders are also suitable where their lower cost becomes a factor, although they fall below the desired value of extrusion constant and tend to resist acid attack due to passivation.

Selection of the materials for the remainder of the components of the filled billet 12 is less critical, but, again, they should have an extrusion constant not unduly disproportionate to that of the rods 10. Generally speaking, low carbon steel will be a satisfactory material for these components.

With the filled billet 12 fabricated within the above parameters, it may then be extruded in a conventional extrusion press employing the following parameters.

Preliminary to extrusion, the filled billet 12 is heated to the extrusion temperature for the specific "high performance" alloy forming the rods 10. Extrusion temperature is generally equated with the forging temperature of the alloy, which is empirically determined and comprises a temperature range as opposed to a finite temperature. The filled billed is soaked at this temperature for a period of time sufficient for all portions of the billet to be evenly heated. Usually a matter of hours are required to eliminate temperature gradients.

Referencing next FIG. 4, the preheated billet 12 is inserted into the liner 24 of an extrusion press 26. The liner may be lubricated by glass powder or other means known in the extrusion art. It is advantageous to dispose a "cut-off" 28 behind the billet 12. The "cut-off" 28 is preheated to approximately two thirds the temperature of the billet 12 and serves to facilitate extrusion of the full length of the billet 12. A hardened steel dummy block 30 is then disposed behind the "cut-off" 28 and is engaged by the stem 32 of the extrusion press.

Upon actuation of the extrusion press 26, the stem 32 applies the necessary force to extrude the billet 12 through the opening of a conical, circular die 34. As the billet 12 is so advanced and extruded, the rods 10 are simultaneously reduced in cross sectional area. The "cut-off" 28 is an expendable item, which enables the full length of the billet 12 to be extruded through the die 34.

In extruding the billet 12, the extrusion pressure is maintained between 50 and 90 tons/inch$^2$. Further, in accordance with the present invention, the opening of the die 34 should be sized relative to the diameter of the liner 24 and the billet 12 to effect a reduction in area between approximately 3 and 45 times and more preferably between 5 and 35 times. Within this area reduction parameter, the extrusion rate is maintained between about 50 and 250 inches per minute and, more preferably within the narrower limits of 75 to 125 inches per minute.

The filled billet, after extrusion, is designated by reference character 12' in FIG. 5. At this point the extruded rods 10 could be removed and would be suitable for many purposes including manual application by gas tungsten arc and atomic-hydrogen arc welding processes of hard facing deposits. The preferred procedure is to crop off about 10% form the extruded length of each end of the billet 12' to eliminate those portions of the rod inserted into the fixtures 16 which tend to be distorted. After cropping, the can 14 may be mechanically removed in whole or in part, as with a bar peeler. The remainder of the can and the filler material 20 are then removed by acid. Typically a 50% nitric acid bath may be employed for such purposes since it will selectively attack the material of the can and the filler material with little or no affect on the "high performance" alloy of the rods.

The extruded rods 10 recovered from the acid bath are elongated and of a reduced diameter which, of course, is a function of the size of the die opening, as well as the initial diameter of the rods and the diameter of the billet. More importantly, the surfaces of the extruded rods, now in wire form, are free of any significant surface striations or other irregularities and may be sized in diameters of 0.095 inch or less. Further, the diameter of the extruded rods will have a tolerance in the order of plus or minus 8%. As indicated above the extrusion product at this point is suitable for many purposes, the rods 10 having been thus converted directly to wire form. It will be acknowledged that the term wire becomes obscured, to some extent, by semantics as to when the diameter of rod is reduced to the point where it may be designated as wire. For present pruposes it is deemed that wire form is a diameter something less than about one-tenth of an inch, or significantly smaller that a diameter which can be achieved by conventional casting procedures.

Another characteristic of the extruded rods, or wires, is that they are substantially free of cracks or voids which might be attributable to casting flaws. Further such extruded rods are relatively flexible and much less brittle than they were in their original cast condition.

In order to obtain wire of more accurately controlled diameter, and indeterminate length, the extruded lengths of wire, indicated by reference character 10' in FIG. 6 are next joined end-to-end. This step is diagrammatically illustrated in FIG. 6, showing the ends of two lengths of wire 10' being joined by butt welding. A usual practice would be to join a sufficient number of lengths 10' to form a coil of wire weighing 50 pounds.

The wire thus formed is then accurately sized by a further working thereof. Preferably this is accomplished by a drawing process. Economically the wire may be cold drawn through commercially available carbide dies on existing drawing equipment. The drawing operation is preferably limited to an area reduction (of the maximum wire diameter) of no more than 10% in any one pass through the die. This correctly infers that more than one drawing operation may be desirable to obtain a desired diameter within the tolerance limits set for a given application for the wire.

Between each pass through the drawing dies it is preferable to anneal the wire. A strand annealing furnace is particularly useful for this purpose in that it enables the wire to be heated to temperatures in the order of 2000° to 2200° F. in a non-oxidizing atmosphere for a period of several minutes and then rapidly cooled to room temperature.

Following the above teachings "high performance" alloy wire may be readily produced in diameters ranging down to 0.010 and tolerances of 0.001 inch or less. There is no theoretical limit to the length of wire that can be produced and it will be capable of being wound on spools of relatively small diameter as are used on automatic welding machines. Further, in welding hard facing deposits, there is no tendency of the wire to "spark" so that fouling of electrodes does not become a problem.

In order to obtain "high performance" alloy wire of further reduced diameter, a second extrusion step can be employed. Preferably this is done by taking the extruded billet 12' after its ends have been cropped off, as indicated in FIG. 5, and then cutting it into segments 12'' of equal length. These segments are then incorporated into a second filled billet, shown in FIG. 6. This second filled billet 36 comprises a can 14' wherein the segments of the first extrusion, identified by reference character 12'', are disposed in parallel relationship to each other and to the axis of the can 14'. The spaces between these segments and between the segments and the interior surface of the can are likewise filled with filler material 20', again selected in accordance with the parameters given above. The second billet 36 is completed by end caps, not shown.

The second filled billet 36 is then preheated and extruded in an extrusion press in accordance with the teachings given above for the extrusion of the billet 12, to thereby effect a further simultaneous reduction in the diameters of the cast rods 10. Following the second extrusion, the lengths of "high performance" alloy wire may be removed as before and, if desired, joined in end-to-end relation to form a wire of desired length, which can likewise be cold drawn to obtain an accurate diameter. The characteristics of the wire obtained through the use of a second extrusion step will be the same as those of wire obtained by a single extrusion, excepting for the smaller diameter obtained.

Practice of the invention will be further apparent from the following specific examples.

EXAMPLE 1

A filled billet 12 was formed to incorporate 198 rods 10 which were Stellite No. 6 castings 26 inches in length with a diameter of 0.335 inch, in an "as cast" condition. The rods 10 were positioned in fixtures 16 having 198 holes of 0.341 inch diameter which maintained them parallel to each other and to the axis of a can 14, which had an inner diameter of 5.75 inches and an outer diameter of 6.625 inches. A front end cap was attached to the can 14 and this sub-assembly turned upright for introduction of filler material 20. Powdered Monel filler material, generally spherical in shape with a maximum diameter of 0.005 inch, was simply poured into the open end of the can. The fixtures 16 were provided with central openings which facilitated the introduction of the Monel powder. As the filler material was introduced, the sub-assembly was agitated to attain a relative density of the filler material of 0.5. The filled billet 12 was then completed by the addition of a rear end cap 22. The can, fixtures and end caps were formed of low carbon steel.

This billet was then heated to a temperature of 1980° F., requiring about eight hours and then soaked at that temperature for an additional two hours. The preheated billet was then placed in a conventional extrusion press and extruded at a rate of 100 inches per minutes with a pressure of 80 tons/inch$^2$ through a 120° conical die having an opening effecting a 16 times reduction. The extrusion force was applied through a "cut-off" which had been preheated to a temperature of about 1250° F.

After being air cooled, the extruded billet was cropped at its opposite ends, removing approximately 10% of the extruded length of the billet from each end. The cropped billet was then placed in a bar peeler and approximately 75% of the extruded thickness of the can removed. After mechanical removal of this portion of the can, the cropped billet was then placed in an acid tank containing a 50% solution of nitric acid. The remaining portions of the can and the Monel filler material were removed by acid attack, permitting recovery of approximately 100 pounds of extruded Stellite No. 6 wire which had a diameter of 0.082±0.005 inch. Between each drawing pass, the wire was annealed by passing it through a strand annealing furnace operating at a temperature of 21500° F. and a feed rate of approximately one inch per second.

The wire thus produced was then wound on a spool and installed on an automatic welding machine of the gas tungsten type. Articles were then hard faced by normal operation of the welding machine with no problems being encountered in the automatic feed of the wire. The resulting weldments had the desired characteristics of weld deposited Stellite No. 6 and were produced without any outgassing or fouling of the tungsten electrodes.

EXAMPLE 2

Cast Stellite No. 12 rods were incorporated into a filled billet and extruded in the same fashion described in Example 1 excepting that the dimensions of the cast rods were 0.320 inch diameter and 13 inches in length and the dimensions of the can 14 and fixtures 16 were modified accordingly. Additionally, the preheat temperature was slightly greater at 2000° F.

The extruded wire lengths recovered after stripping had a diameter of 0.080±0.005 inch. The wire lengths were butt welded to form a single coil of wire which was then cold drawn by three successive passes, with annealing between each pass, to a diameter of 0.065±0.001 inch. The wire so formed had a smooth surface and demonstrated the same utility as the wire of Example 1.

EXAMPLE 3

Nineteen cast rods of PWA694 alloy having a diameter of 0.250 inch and a length of five inches were incorporated into a proportionately scaled filled billet of reduced size. This billet was then preheated to a temperature of 2050° F. for a period of three hours.

After preheating, the billet was extruded to an eight times reduction with an extrusion rate of about 90 inches per minute at a pressure of 80 tons per inch$^2$. After air cooling, the ends of the extruded billet were cropped and it was cut into seven pieces each having a length of five inches and a wire diameter of 0.115 inches within the extruded bar. These seven peices were then loaded into a can having an outside diameter of 4.0 inches and an inside diameter of 3.5 inches. The spaces between the pieces of extruded rod and between the pieces and the second can were filled with powdered Monel filler material settled to a density of 0.5 and end plates added to form a second filled billet. This second filled billet was preheated to a temperature of 2050° F. for a period of three hours. The second billet was then extruded to eight times reduction at an extrusion rate of about 90 inches per minute and an extrusion pressure of 70 tons per inch$^2$.

After cropping and stripping in a nitric acid bath extruded wires 25 inches in length with a diameter of 0.033±0.002 inches were recovered. The wire was smooth and quite flexible. In manual hard facing of regions of high wear on nozzle vanes used in a jet air craft engine, the wire was found to produce precise high quality deposits without outgassing or cracking of the vane surface, or the substrate, which is very sensitive to thermal shock.

EXAMPLE 4

Example 3 was repeated to demonstrate utility of the invention in processing additional "high performance" alloy, hard facing wire. Six additional filled billets were fabricated, respectively incorporating cast rods of Stellite No. 1, Stellite No. 21, Stellite No. 40, Stellite No. 41, PWA 964, Tribaloy 400 and Tribaloy 800.

Each of these filled billets was extruded in the same fashion as described in Example 3, excepting that the preheat temperature for the billets in which the Stellite No. 40 and Stellite No. 41 rods were incorporated was 1700° F.

The extruded wires recovered after cropping and stripping in a nitric acid bath were dimensionally equivalent to the wires recovered in Example 3 and exhibited the same characteristics of smoothness and flexibility making them suitable for manual welding of hard facing deposits.

From the foregoing examples and with reference to FIG. 8, it will be seen that the present invention includes the basic steps of incorporating cast "high performance" alloy rods into a filled billet, extruding the filled billet, an optional second extrusion step, separating the extruded wire from the billet and the further, preferred step of joining the extruded wires, as by butt welding, to form a coilable wire of indeterminate length, and cold drawing the wire so formed to obtain a desired diameter within close tolerance limits, with the wire being annealed between successive drawing operations.

The methods, as thus defined, enables the production of "high performance" alloys in small wire diameters particularly suited for hard surfacing in a more economical and precise fashion than has been hitherto possible. The method also makes available for hard surfacing, many "high performance" alloys which have heretofore been unavailable because of the difficulties of producing them in a small diameter form, usable in manual or automatic techniques.

While the primary thrust of the present invention and its narrower aspects are limited to the production of "high performance" alloy wire for use in hard surfacing applications, it will be apparent to those skilled in the art that the broader aspects of the invention, will enable the production of small diameter wire or elongated "high performance" alloy components having a high length to diameter ratio. All of which leads to the interdiction that variations from the specifics herein described will occur to those skilled in the art within the spirit and scope of the present inventive concepts which are to be derived from the following claims.

Having thus described the invention, what is claimed as novel and desired to be secured by Letters Patent of the United States is:

1. A method of manufacturing wire and other components having a high length to cross section ratio comprising the steps of positioning a plurality of rods into a can in parallel relation with each other and parallel to the axis of the can, said rods being castings of a "high performance" alloy in an "as cast condition" and having a diameter between approximately one eighth inch and one half inch, closing off one end of said can with a cap, introducing powdered filler material into said can to fill the spaces between said rods and between the rods and the interior surface of said can, said filler material being generally spherical with a diameter of less than 0.005 inch, said filler material being further characterized by an extrusion constant within approximately 40% of the extrusion constant of said rods, compacting said filler material to a relative density of at least 0.33, attaching a cap to the other end of said can to thus complete a filled billet in which the rods are incorporated, heating said filled billet to a temperature approximating the forging temperature of said rods for a period of time sufficient for all portions of the billet to reach such temperature, placing said preheated, filled billet in an extrusion press and extruding said billet at a pressure between approximately 30 and 120 tons/inch$^2$ at a rate between about 50 and 250 inches per minute through a die affecting an area reduction in the cross section between 3 and 45 times, allowing the extruded filled billet to air cool, and removing the extruded "high performance" alloy rods from the can and filler material.

2. A method of manufacturing wire as in claim 1 comprising the further steps of cropping off the ends of the extruded filled billet prior to removal of the extruded "high performance" alloy rods, joining the extruded "high performance" alloy rods end-to-end to form a wire of desired length, and drawing said wire through a die to effect a further reduction in diameter and accurately size the wire to a desired diameter.

3. A method of manufacturing wire as in claim 2 comprising the further steps of annealing the drawn wire and then drawing the annealed wired through a die to affect a still further reduction in diameter and greater accuracy in its diameter.

4. A method of manufacturing wire as in claim 1 wherein the "high performance" alloy is selected from the group consisting of cobalt-base and nickel-base alloys having a content ranging about 0.90% and 4.00% of the group comprising carbon and boron, the area reduction is between 5 and 35 times, and the extrusion rate is between 25 and 125 inches per minute.

5. A method of manufacturing wire as in claim 2 comprising the further steps of incorporating the extruded "high performance" alloy rods into a second filled billet, preheating the second filled billet to a temperature approximating the forging temperature of said rods for a period sufficient for all portions of the second filled billet to be brought to that temperature, placing the preheated, second filled billet in an extrusion press and extruding said second billet at a pressure between approximately 30 and 120 tons/inch$^2$ at a rate between 80 and 250 inches per minute through a conical die affecting an area reduction in cross section between 3 and 45 times, and removing the extruded "high performance" alloy rods from the second filled billet after it has cooled to room temperature.

6. A method of manufacturing wire as in claim 5 wherein the ends of the first filled billet, after extrusion, are cropped off and the cropped billet is then cut into a plurality of segments, said segments are placed into a second can which is filled with filler material and caps are placed on the ends of the can to form the second billet.

* * * * *

UNITED STATES PATENT AND TRADEMARK OFFICE

CERTIFICATE OF CORRECTION

PATENT NO. : 4,209,122

DATED : June 24, 1980

INVENTOR(S) : James G. Hunt

It is certified that error appears in the above—identified patent and that said Letters Patent is hereby corrected as shown below:

Column 4, line 4, "inention" should read -- invention --.

Column 4, line 23, "cabalt" should read -- cobalt --.

Signed and Sealed this

*Thirteenth* Day of *January 1981*

[SEAL]

*Attest:*

SIDNEY A. DIAMOND

*Attesting Officer*

*Commissioner of Patents and Trademarks*